US006022233A

United States Patent [19]

Daoud

[11] Patent Number: 6,022,233

[45] Date of Patent: Feb. 8, 2000

[54] LOCKABLE CUSTOMER BRIDGE

[75] Inventor: Bassel Hage Daoud, Parsippany, N.J.

[73] Assignee: Lucent Technologies Inc., Murray Hill, N.J.

[21] Appl. No.: 09/107,493

[22] Filed: Jun. 30, 1998

[51] Int. Cl.[7] ..... H01R 13/62

[52] U.S. Cl. ..... 439/304; 379/399; 439/133

[58] Field of Search ..... 439/133, 304; 379/399, 445

[56] References Cited

U.S. PATENT DOCUMENTS

| | | | |
|---|---|---|---|
| 4,979,209 | 12/1990 | Collins et al. | 439/133 |
| 5,004,433 | 4/1991 | Daoud | 439/502 |
| 5,312,266 | 5/1994 | Daoud | 439/304 |
| 5,370,547 | 12/1994 | Daoud | 439/304 |
| 5,550,916 | 8/1996 | Daoud | 349/399 |
| 5,591,038 | 1/1997 | Guzay et al. | 439/133 |
| 5,888,079 | 3/1999 | Norden | 439/133 |

*Primary Examiner*—Steven L. Stephan
*Assistant Examiner*—T C Patel

[57] ABSTRACT

A customer bridge, also known as a network interface device, is provided with structural features to deter tampering with, or unauthorized use of, phone services. The customer bridge includes first and second extended flanges located on opposite sides of an RJ-11 jack. The first and second extended flanges include first and second through holes, respectively. A shackle may be passed through the first and second through holes and secured to a padlock to prevent removal of an RJ-11 plug from the RJ-11 jack, or to block access to an empty RJ-11 jack.

20 Claims, 3 Drawing Sheets

LOCKABLE CUSTOMER BRIDGE

FIELD OF THE INVENTION

This invention relates to a customer bridge, also known as a network interface device (NID), for connecting a customer's phone lines to a service provider's phone lines. More particularly, the present invention relates to a customer bridge having a connection jack so that the customer can connect a phone directly to the service provider's phone lines, and having a locking arrangement so that the connection jack is only accessible by the customer.

BACKGROUND OF THE INVENTION

In a large apartment complex, there are numerous customers subscribing to phone services. Each phone customer has phone lines meandering past the floors and rooms of the apartment complex. All of the phone lines converge in one area of the apartment complex, usually located in the basement, or first floor level.

The phone service provider's lines enter the apartment complex in the converging area. Each customers' phone lines are coupled to respective phone lines of the service provider. Each coupling occurs by way of a separate customer bridge. Typically, an electrical component box houses the customer bridges. The electrical component box protects the customer bridges from contaminates. The electrical component box also provides an orderly way to identify the customer bridges, such as by customer name, phone number, apartment number, etc., to facilitate trouble-shooting, modification, and/or repair of the phone lines associated with a particular phone service customer.

Occasionally a customer will have problems with their phone service, such as a loss of service or excessive noise. Typically, the customer, and/or apartment association, owns the phone lines and phone equipment within the apartment complex. Therefore, if the problem resides within the apartment complex, the costs of repair are the responsibility of the customer or apartment association. If the problem resides outside the apartment complex, the costs of repair are the responsibility of the phone service provider.

The electrical component box, containing the customer bridges, is defined as the property dividing line between the customers/apartment association and the phone service provider. Therefore, it is important to allow each of the apartment residents access to the customer bridge associated with their phone lines. Further, it is important to provide some device at the customer bridge, which allows the customer to determine if the phone service problem is the result of a fault within the apartment complex or outside the apartment complex. To this end, each customer bridge includes a jumper phone line having a standard RJ-11 plug and a standard RJ-11 jack for receiving the RJ-11 plug. The RJ-11 plug and RJ-11 jack allow the connection to the phone service provider to be easily disconnected and reconnected.

By constructing the customer bridge in this manner, if a problem occurs in the phone service, the customer can take a working phone to the basement, locate their customer bridge, unplug the RJ-11 plug from the RJ-11 jack and plug in the RJ-11 plug of the working phone into the RJ-11 jack. If the problem persists, the customer will realize that the source of the problem is with phone service provider's lines. If the problem is corrected, the customer will realize that the source of the problem resides somewhere between the customer's apartment wall jack and their customer bridge, in other words, within the apartment complex's wiring.

Unfortunately, allowing customers access to the customer bridges creates a situation conducive to phone service theft.

Any unscrupulous person could bring a phone to the basement of the apartment complex, disconnect the customer bridge of one of the tenants, plug in the phone, and make an unauthorized phone call. The victimized tenant would most likely be unaware of the theft, since their phone lines would be disconnected during the unauthorized call. Only later, when the phone bill arrives, would the victimized tenant realize that a call was made.

One solution has been to restrict access to the basement and/or the electrical component box housing the customer bridges, by locking these areas, and only permitting tenants access to the customer bridges while in the presence of apartment complex personnel. This solution causes inconvenience and labor expenses to both the residents and the apartment complex personnel. Another solution has been to provide keys to the basement and the electrical component box to all of the tenants of the building. In large apartment complexes, this solution has proved unsatisfactory, since one or more unscrupulous tenants, having keys, will steal phone services from their fellow tenants.

SUMMARY OF THE INVENTION

The customer bridge of the present invention overcomes one or more of the disadvantages associated with the customer bridges of the background art. The customer bridge of the present invention includes structural features, which allow a padlock to be used in conjunction with the customer bridge to prevent removal of the RJ-11 plug of the jumper phone wire from the RJ-11 jack of the customer bridge. The padlock could also prevent the plugging in of an RJ-11 plug of a phone or jumper phone line into an empty RJ-11 jack of the customer bridge.

Although the locking arrangement is disclosed in conjunction with a customer bridge, it should be appreciated that the locking arrangement could be adapted to other types of phone connectors, besides a customer bridge, such as a standard wall plate phone outlet, the phone jack of a telephone base, a modem jack of computer, or any other type of phone jack. Further, the locking arrangement could be employed in conjunction with other forms of electrical connectors, such as RCA patch cord terminals, phono plugs, 110 or 220 volt electrical plugs, fiber optic cable terminals, etc.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION

Figure 1:
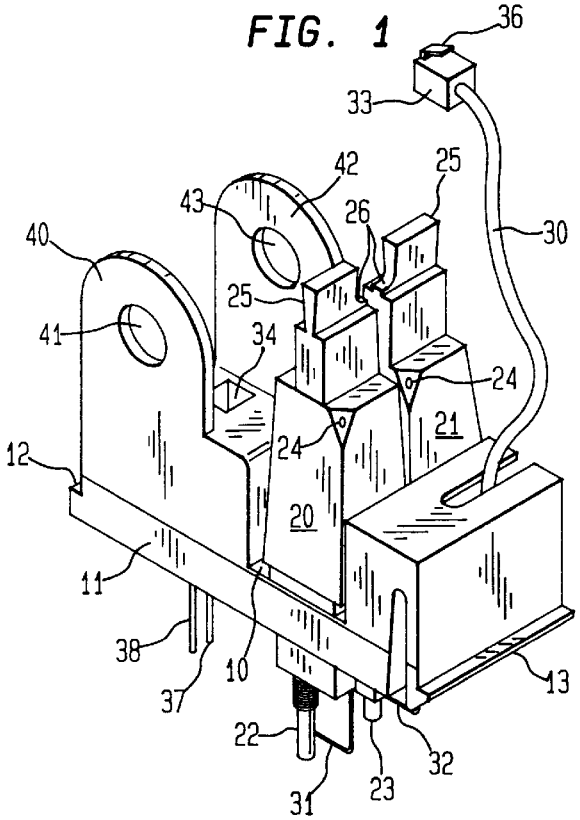
FIG. 1 is a perspective view of a lockable customer bridge, in accordance with the present invention.
Figure 2:
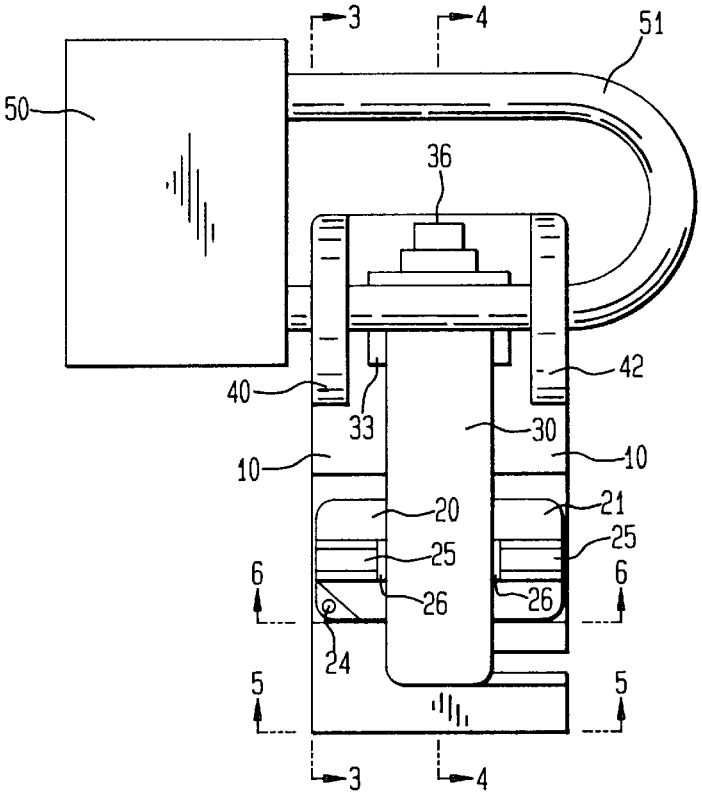
FIG. 2 is an overhead view of the lockable customer bridge, with a padlock blocking removal of an inserted RJ-11 plug.

FIG. 1 illustrates a lockable customer bridge in accordance with the present invention. The lockable customer bridge includes a base 10. The base 10 includes two ridge portions 11 extending from opposite ends thereof. The base 10 also includes a mounting hook 12 and a mounting clip 13 located on two other opposed ends thereof. The mounting hook 12 and mounting clip 13 are used to mounted the customer bridge into a cutout slot 14 formed in a wall 15 of an electrical component box.

To mount the customer bridge into the wall 15 of the electrical component box, the mounting hook 12 is first inserted into the cutout slot 14 and hooked upon a first edge 16 of the cutout slot 14. Next, the mounting clip 13 is snapped past an opposite edge 17 of the cutout slot 14. The mounting clip 13 provides a resilient pressure, which firmly connects the customer bridge to the wall 15 of the electrical component box, yet allows the customer bridge to be removed when service is required.

The base 10 includes several electrical connector elements mounted thereto. A first insulation displacement connector (IDC) 20 is connected to the base 10. A second IDC 21 is also connected the base 10. The function of the first IDC 20 is to electrically connect a first phone wire (not shown), which meanders past the rooms and floors of the apartment complex and is connected to a customer's wall phone jack, to a wire wrap terminal 22. The function of the second IDC 21 is to electrically connect a second phone wire (not shown), which meanders past the rooms and floors of the apartment complex and is connected to the same customer's wall phone jack, to a second wire wrap terminal 23. The physical structure of the second IDC 21 is quite similar to the physical structure of the first IDC 20. Therefore, only the operation of the first IDC 20 will be described.

Figure 3:
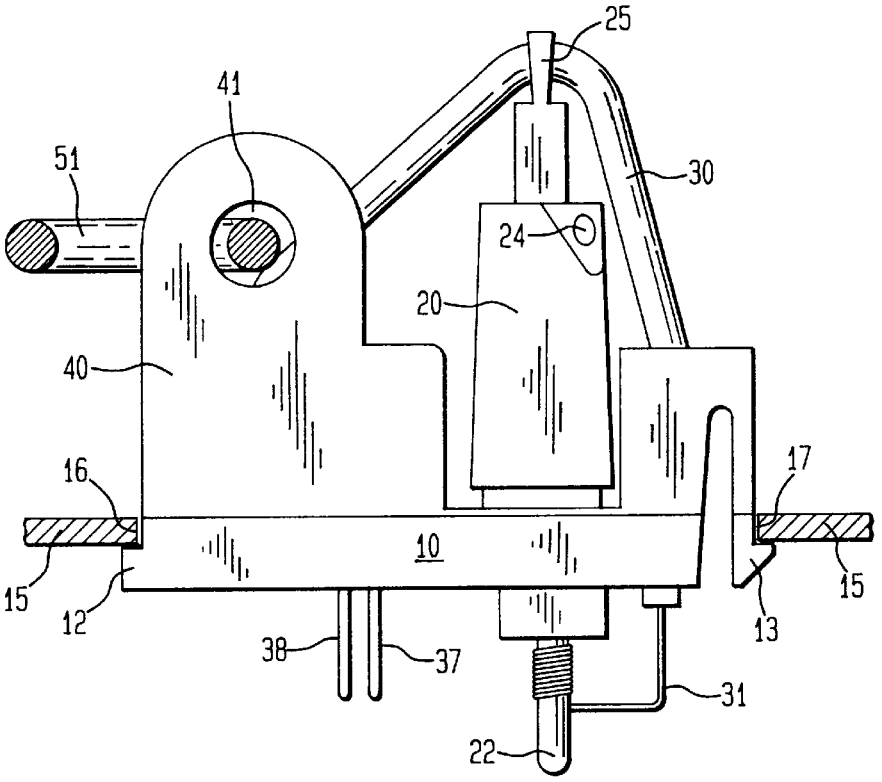
FIG. 3 is a cross sectional view taken along line 3—3 of FIG. 2.
Figure 4:
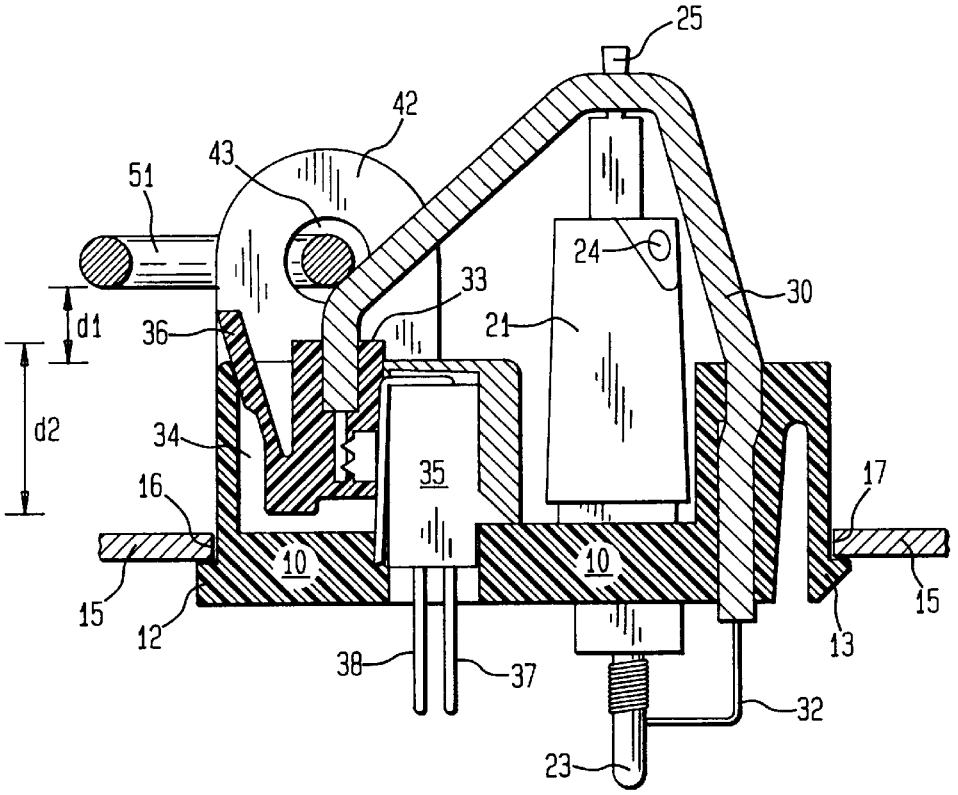
FIG. 4 is a cross sectional view taken along line 4—4 of FIG. 2.
Figure 5:
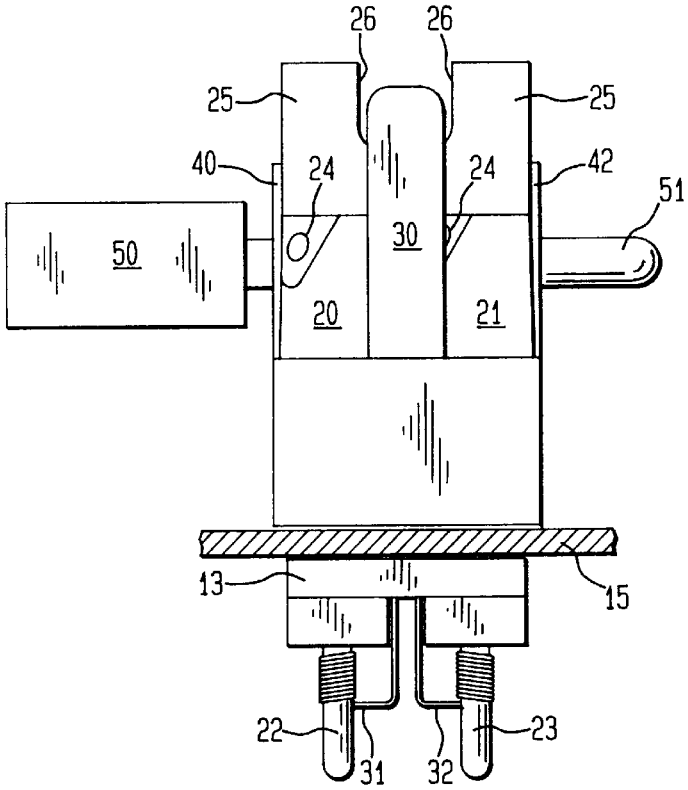
FIG. 5 is a cross sectional view taken along line 5—5 of FIG. 2.
Figure 6:
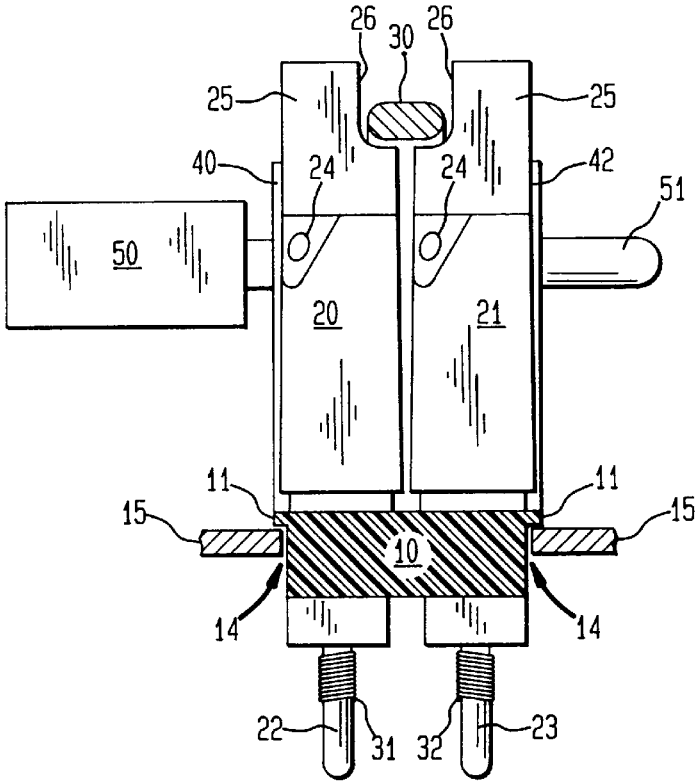
FIG. 6 is a cross sectional view taken along line 6—6 of FIG. 2.

The first IDC 20 is initially located in a raised position relative to the base 10, as illustrated in FIG. 1. The first phone wire, insulation enact, is inserted into an opening 24 formed in a midportion of the first IDC 20 by a service technician. Inside the first IDC 20, the first phone wire comes into contact with a conductive frame member, which is electrically connected to the first wire wrap terminal 22. A finger grip portion 25 is integrally formed on an upper portion of the first IDC 20. The service technician applies a downward pressure onto the finger grip portion 25. The downward pressure causes the first IDC 20 to snap-lock into a lowered position, as illustrated in FIGS. 3–4 and 6.

When the first IDC 20 is snap-locked into its lower position, the insulation of the first phone wire is cut by the conductive frame member inside the first IDC 20. The first phone wire is then frictionally engaged by the conductive frame member, and thereby establishes good electrical conductivity with the first wire wrap terminal 22.

Removal of the first phone wire is essentially the reverse of the above operation. Namely, the service technician pulls upwardly on the finger grip portion 25 causing the first IDC 20 to snap upwardly away from the base 10. When the first IDC 20 is in its upward position, the frictional engage between the first phone wire and the conductive frame member is released, and the service technician can remove the first phone wire from the first opening 24. By this arrangement, the first and second phone wires, coming from a customer's wall jack, can be quickly and easily electrically connected and disconnected by a service technician to the first and second wire wrap terminals 22 and 23, respectively. More background information concerning the construction and function of an IDC can be found in Applicant's prior U.S. Pat. No. 5,004,433, issued Apr. 2, 1991, the disclosure of which is hereby incorporated by reference.

The customer bridge also includes a flexible jumper phone line 30. The jumper phone line 30 has a first jumper wire 31 and a second jumper wire 32. One end of the first jumper wire 31 is wrapped about the first wire wrap terminal 22. One end of the second jumper wire 32 is wrapped about the second wire wrap terminal 23. The other end of the first jumper wire 31 is electrically connected to a terminal of a standard, RJ-11 plug 33. The other end of the second jumper wire 32 is electrically connected to a different terminal of the RJ-11 plug 33. By this arrangement, the first and second phone wires, coming from the customer's wall jack, are electrically connected to terminals of the RJ-11 plug 33.

A standard, RJ-11 jack 34 is provided on the upper surface of the base 10. The RJ-11 jack 34 has a terminal section 35 on a first inside wall. The terminal section 35 can be a standard type 645 snap-in insert member, or the terminal section 35 can be provided as terminals integrally formed with the RJ-11 jack 34. The terminal section 35 mates with the terminals of the RJ-11 plug 33 to establish electrical conductivity therewith. On a second inside wall of the RJ-11 jack 33, opposed to the first inside wall, a locking détente is provided to engage with a mating clip formed on a cantilevered portion 36 of the RJ-11 plug 33. By this arrangement, electrical conductivity is established between the terminals of the RJ-11 plug 33 and the terminal section 35 of the RJ-11 jack 34, when the RJ-11 plug 33 is engaged within the RJ-11 jack 34.

A first terminal section connector 37 and a second terminal section connector 38 are electrically connected to the terminals of the terminal section 35. First and second, phone service provider's phone lines (not shown) are electrically connected to the first and second terminal section connectors 37 and 38. Thereby, when the RJ-11 plug 33 is inserted into the RJ-11 jack 34, the customer's phone lines are electrically connected to the phone service provider's phone lines. Phone service is established, and the customer may make calls from a phone plugged into the wall plate outlet of their apartment.

Now the structure of the locking arrangement of the customer bridge will be described. A first locking flange 40 is provided beside the RJ-11 jack 34. The first locking flange 40 extends well beyond the opening of the RJ-11 jack 34. A first through hole 41 is formed in a mid-portion of the first locking flange 40, located above the opening of the RJ-11 jack 34. A second locking flange 42 is provided on another side of the RJ-11 jack 34, opposite to the first locking flange 40. The second locking flange 42 also extends well beyond the opening of the RJ-11 jack 34. A second through hole 43 is formed in a midportion of the second locking flange 42. The second through hole 43 is aligned with the first through hole 41.

The diameters of the first through hole 41 and second through hole 43 are large enough to receive a shackle 51 of a padlock 50 therethrough. When the padlock 50 is installed, the shackle 51 is spaced from the opening of the RJ-b 11jack 34 by a first distance d1. The first distance d1 is less than a second distance d2, defined by a length of the RJ-11 plug 33, as illustrated in FIG. 4. By this arrangement, an installed RJ-11 plug 33 cannot be removed from the RJ-11 jack 34, when the shackle 51 is present. Also, an unstalled RJ-11 plug 33 cannot be installed into an empty RJ-11 jack 34, when the shackle 51 is present.

Now, the basic installation of the customer bridge of the present invention will be described. A service technician inserts the phone lines of the customer into the first and second openings of the first and second IDCs 20, 21. The service technician presses down on the first and second IDCs 20, 21, and thereby both mechanically and electrically connects the customer's phone lines to the customer bridge. The service technician electrically connects the first and second terminal section connectors 37, 38 of the terminal section 35 to the phone service provider's lines. The customer bridge is installed into the cut-out 14 in the wall 15 of the electrical component box. Finally, the RJ-11 plug 33 is installed into the RJ-11 jack 34. At this point, phone service is provided to the customer's wall jack. Although a particular sequence has been given to the events of the basic installation of the customer bridge, it should be appreciated that the particular sequence may be altered while still achieving the result of installing the customer bridge.

Now, the operation of the locking arrangement will be described. A customer inserts the shackle 51 of their personal padlock 50 through the aligned first and second through holes 41, 43 of the first and second locking flanges 40, 42, and the padlock 50 is locked. Only the customer will possess the key to open their personal padlock 50. By the above arrangement, the customer gains some level of assurance that the RJ-11 plug 33 cannot be easily removed from the RJ-11 jack 34. Therefore, the customer is provided a degree of protection against unauthorized persons stealing phone services via their customer bridge.

Instead of the padlocks 50 being the personal property of the customer, the padlocks 50 could, of course, be provided by the apartment complex or the phone service provider. It is also envisioned that a phone service technician and/or a service person of the apartment complex would have a master key fitting all the padlocks 50 of the customer bridges installed in the electrical component box.

An additional security feature of the locking arrangement of the present invention, is that the phone jumper line 30 engages shoulders 26 formed in the finger grip portions 25 of the first and second IDCs 20, 21 when the RJ-11 plug 33 is inserted into the RJ-11 jack 34. The engagement prevents the first and second IDCs 20, 21 from being snapped upwardly so long as the RJ-11 plug 33 remains inside the RJ-11 jack 34. Therefore, when the padlock 50 prevents removal of the RJ-11 plug 33 from the RJ-11 jack 34, the padlock is simultaneously preventing the unauthorized removal of the customer's phone lines from the openings 24 of the first and second IDCs 20, 21.

Although the locking arrangement has been described in conjunction with a customer bridge, it should be appreciated that the first and second locking flanges 40, 42 could be provided on opposite sides of a standard wall plate phone outlet, a modem jack of a computer, a cord jack of a telephone base, or any other type of phone jack. Such an arrangement would deter persons from bypassing a pay phone, accessing a restricted phone line, bypassing child locks, or from connecting phone equipment not approved to be installed in a particular phone network system.

Further, the first and second locking flanges could be employed on electrical connectors other than phone jacks. For example, phone plugs, RCA-type patch cord terminals, 110 or 220 volt electrical plugs, fiber optic cable terminals, etc. Such applications could be useful in hotel rooms, public conference rooms, or wherever it is desired to prevent persons from altering, disconnecting, or connecting electrical plugs.

For instance, a public address system in a hotel conference room may include a number of interconnected electrical components, like an amplifier, mixer, speakers and microphone. RCA-type patch cords, speaker wires, and microphone cables interconnect these components in a specific manner. Often untrained users of the conference room will, without authority, tamper with, or modify, the interconnections of the components, and possible damage the components.

By using the above terminal locking invention, the hotel staff could deter unauthorized persons from disconnecting or modifying the interconnection of the system components. The terminal locking invention could also be used to block empty terminals of the system components to prevent unauthorized persons from adding their own personal components to the address system, which might damage the system. The locking arrangement would even deter theft of the equipment, since all the components would be ganged together.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A customer bridge for electrically connecting a first phone line to a second phone line, said customer bridge comprising:

a base;

a first quick connector connected to said base;

an RJ-11 plug having a predetermined length and having a first terminal;

a first jumper wire connecting said first quick connector to said first terminal of said RJ-11 plug;

an RJ-11 jack connected to said base, said RJ-11 jack for receiving said RJ-11 plug; and a locking portion connected to said base, said locking portion being located adjacent said RJ-11 jack, and being provided to selectively block or allow removal of said RJ-11 plug from said RJ-11 jack while simultaneously preventing or allowing actuating movement of said first quick connector.

2. A customer bridge according to claim 1, wherein said locking portion includes a first flange extending beyond side edges surrounding an opening of said RJ-11 jack, said first flange including a first through hole.

3. The customer bridge according to claim 2, wherein said locking portion further includes a lock having a shackle, and wherein said shackle extends through said first through hole in said first flange to at least partially pass over said RJ-11 jack.

4. The customer bridge according to claim 3, wherein said lock is a padlock.

5. The customer bridge according to claim 4, wherein a center of said first through hole is spaced from at least one of said side edges of said RJ-11 jack a distance less than the predetermined length of said RJ-11 plug.

6. The customer bridge according to claim 4, further comprising a second flange connected to said base and extending beyond said side edges of said RJ-11 jack, said second flange having a second through hole.

7. The customer bridge according to claim 6, further comprising a padlock having a shackle, said shackle extending through said first through hole and said second through hole and at least partially passing over said RJ-11 jack.

8. The customer bridge according to claim 1, wherein said first quick connector is a first insulation displacement connector and wherein said first jumper wire physically engages against said first insulation displacement connector to prevent actuating movement of said first insulation displacement connector, when the locking portion is positioned to block removal of said RJ-11 plug from said RJ-11 jack.

9. The customer bridge according to claim 8, further comprising:

a second insulation displacement connector connected to said base;

a second terminal located on said RJ-11 plug; and a second jumper wire connecting said second insulation displacement connector to said second terminal of said RJ-11 plug, wherein said first and second jumper wires physically engage against said first and second insulation displacement connectors to prevent actuating movement of either of said first or second insulation displacement connectors, when said locking portion is positioned to block removal of said RJ-11 plug from said RJ-11 jack.

10. A communications connector having lockable access thereto, said connector comprising:

a base;

a jack connected to said base, said jack having an open end adapted to receive a plug, said open end being defined by side edges;

a first flange connected to said base;

a second flange connected to said base;

a first through hole provided in said first flange; and a second through hole provided in said second flange, said second through hole being at least approximately aligned with said first through hole such that an alignment line, beginning at said first through hole and ending at said second through hole, passes over a portion of said open end of said jack.

11. The communications connector according to claim 10, further comprising:

a lock having a shackle, said shackle extending through said first through hole and through said second through hole with a portion of said shackle intermediate said first and second flanges being disposed over said open end of said jack.

12. The electrical connector according to claim 11, wherein said lock is a padlock.

13. A communications connector having lockable access thereto, said connector comprising:

a base;

a jack connected to said base, said jack having an open end adapted to receive a plug, said open end being defined by side edges;

a first flange connected to said base, said first flange being located adjacent said jack, and said first flange extending beyond said side edges of said open end of said jack;

a first through hole provided in said first flange; and a lock having a shackle, said shackle extending through said first through hole and at least partially passing over said open end of said jack, such that when said jack includes said plug, said shackle provides a direct physical barrier to removal of said plug, and when said jack is empty, said shackle provides a direct physical barrier to insertion of said plug into said jack.

14. The communications connector according to claim 13, wherein said lock is a padlock.

15. A phone jack having lockable access thereto, said phone jack comprising:

a base;

a phone jack connected to said base, said phone jack having an open end adapted to receive a phone plug, said open end being defined by side edges;

a first flange connected to said base and extending beyond said side edges of said open end of said phone jack;

a first through hole provided in said first flange; and a lock having a shackle, said shackle extending through said first through hole and at least partially passing over said open end of said phone jack, such that when said phone jack includes said phone plug, said shackle provides a direct physical barrier to removal of said phone plug, and when said phone jack is empty, said shackle provides a direct physical barrier to insertion of said phone plug into said phone jack.

16. The phone jack according to claim 15, wherein said lock is a padlock.

17. The phone jack according to claim 15, further comprising a second flange connected to said base and extending beyond said side edges of said open end of said phone jack, said second flange having a second through hole through which said shackle passes.

18. The phone jack according to claim 15, further comprising an RJ-11 plug for plugging into said phone jack, and wherein said phone jack is an RJ-11 jack.

19. A method of securing a customer bridge comprising the steps of:

providing a customer bridge, the customer bridge having: a jumper phone line with a plug; a jack; first and second flanges located adjacent to the jack and extending above the jack; first and second through holes formed in the first and second flanges, respectively; and a lock with a shackle;

connecting the plug into the jack;

inserting the shackle of the lock through the first through hole, over the jack, and through the second through hole; and securing the shackle with the lock to block removal of the plug from the jack.

20. A method according to claim 19, further comprising the steps of:

providing first and second insulation displacement connectors on the customer bridge; and engaging the jumper phone line against the first and second insulation displacement connectors during said connecting step, to thereby prevent activating movement of either of the first or second insulation displacement connectors, after said step of securing the shackle with the lock.

* * * * *